US008781055B2

(12) United States Patent
Toth et al.

(10) Patent No.: US 8,781,055 B2
(45) Date of Patent: Jul. 15, 2014

(54) METHOD AND SYSTEM FOR RADIOISOTOPE GENERATION

(75) Inventors: James J. Toth, Pasco, WA (US); Chuck Z. Soderquist, Benton City, WA (US); Lawrence R. Greenwood, Richland, WA (US); Shas V. Mattigod, Richland, WA (US); Glen E. Fryxell, Kennewick, WA (US); Matthew J. O'Hara, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 851 days.

(21) Appl. No.: 12/939,081

(22) Filed: Nov. 3, 2010

(65) Prior Publication Data

US 2012/0106691 A1 May 3, 2012

(51) Int. Cl.
*G21G 1/00* (2006.01)

(52) U.S. Cl.
CPC ..... *G21G 1/0005* (2013.01); *G21G 1/001* (2013.01); *G21G 2001/0042* (2013.01)
USPC ..... 376/186

(58) Field of Classification Search
USPC ..... 376/186
See application file for complete search history.

(56) References Cited

U.S. PATENT DOCUMENTS 4,782,231 A * 11/1988 Svoboda et al. ..... 423/249
5,275,802 A * 1/1994 Knapp et al. ..... 424/1.29
5,729,821 A * 3/1998 Knapp et al. ..... 423/2
6,326,326 B1 12/2001 Feng et al.
6,531,224 B1 * 3/2003 Fryxell et al. ..... 428/405
7,554,098 B2 * 6/2009 O'Hara et al. ..... 250/432 PD
2003/0194364 A1 * 10/2003 Bond et al. ..... 423/2

FOREIGN PATENT DOCUMENTS

WO PCT/US2011/049330 5/2013

OTHER PUBLICATIONS

International Search Report/Written Opinion for PCT/US2011/049330 dated Jan. 9, 2012.*
Chattopadhyay, S., et al., A novel 99mTc delivery system using (n, y)99Mo adsorbed on a large alumina column in tandem with Dowex-1 and AgCl columns, Applied Radiation and Isotopes, 57, 2002, 7-16.*
Dadachov, M. S., et al., Development of a titanium tungstate-based 188W/188Re gel generator using tungsten of natural isotopic abundance, Applied Radiation and Isotopes, 57, 2002, 641-656.*
Fryxell, G. E., et al., Design and Synthesis of Selective Mesoporous Anion Traps, Chem. Mater., 1999, 11, 2148-2154.*

(Continued)

*Primary Examiner* — Jack W Keith
*Assistant Examiner* — Sean P Burke
(74) *Attorney, Agent, or Firm* — Wells St. John P.S.

(57) ABSTRACT

A system and a process for producing selected isotopic daughter products from parent materials characterized by the steps of loading the parent material upon a sorbent having a functional group configured to selectively bind the parent material under designated conditions, generating the selected isotopic daughter products, and eluting said selected isotopic daughter products from the sorbent. In one embodiment, the process also includes the step of passing an eluent formed by the elution step through a second sorbent material that is configured to remove a preselected material from said eluent. In some applications a passage of the material through a third sorbent material after passage through the second sorbent material is also performed.

15 Claims, 7 Drawing Sheets

| | Sorbent | | | | Mo Loading (1hr) | | | | | |
|---|---|---|---|---|---|---|---|---|---|---|
| ID | SAMMS Material | Ligand | Anion | Mass, mg | Soln pH | Vol | Mo99 C(initial) μ=Ci/mL | Mo99 C(final μ=Ci/mL | Mo99 μ=Ci/g SAMMS | Mo μ=g/g SAMMS |
| 13-01 | SES#1 | Cu-EDA | $Cl_2$ | 40.1 | 4.91 | 5.9 | 1.24E-01 | 3.67E-03 | 17.65 | 95.61 |
| 13.02 | Davisil635 | Cu-EDA | $SO_4$ | 40.3 | 4.9 | 5.9 | 1.24E-01 | 9.87E-03 | 16.65 | 90.22 |
| 13.03 | SES#1 | Cu-EDA | $SO_4$ | 40.6 | 4.95 | 5.9 | 1.24E-01 | 2.23E-02 | 14.73 | 79.79 |
| 13-04 | PhenC | Carbon | $SO_4$ | 39.9 | 5.01 | 5.9 | 1.24E-01 | 7.67E-02 | 6.93 | 37.57 |
| 13-05 | Davisil635 | Cu-EDA | $SO_4$ | 40.6 | 4.94 | 5.9 | 124E-01 | 2.06E-02 | 14.97 | 81.13 |
| 13-06 | PhenC | Carbon | $SO_4$ | 40.8 | 5.02 | 5.9 | 1.24E-01 | 7.62E-02 | 6.85 | 37.11 |
| 13-07 | Control | NA | NA | 0 | 5.02 | 5.9 | 1.23E-01 | 1.24E-01 | NA | NA |

(56) References Cited

OTHER PUBLICATIONS

Fryxell, G. E., et al., Actinide Sequestration Using Self-Assembled Monolayers on Mesoporous Supports, Environ. Sci. Technol., 39, 2005, 1324-1331.*

Fryxell, G. E., et al. , Design and synthesis of self-assembled monolayers on mesoporous supports (SAMMS): The importance of ligand posture in functional nanomaterials, J. Mater. Chem., 17, 2007, 2863-2874.*

Knapp, F. F. Jr., et al., Processing of Reactor-produced 188W for Fabrication of Clinical Scale Alumina-based 188W/188Re Generators, Appl. Radiat. Isot. 45, 12, 1994, 1123-1128.*

Lee, J. S., et al., Development of a high performance 188W/188Re generator by using a synthetic alumina, Applied Radiation and Isotopes, 67, 2009, 1162-1166.*

Lin, Y., et al., Incorporation of Hydroxypyridinone Ligands into Self-Assembled Monolayers on Mesoporous Supports for Selective Actinide Sequestration, Environ. Sci. Technol., 2005, 39, 1332-1337.*

Liu, J. , et al., Synthesis and Applications of Functionalized Nanoporous Materials for Specific Adsorption, Studies in Surface Science and Catalysis, 129, 2000, pp. 729-738.*

Mattigod, S. V., et al., Separation of Complexed Mercury from Aqueous Wastes Using Self-Assembled Mercaptan on Mesoporous Silica, Separation Science and Technology, 34, 12, 1999, 2329-2345.*

Mattigod, S. V., et al., Evaluation of novel getters for adsorption of radioiodine from groundwater and waste glass leachates, Radiochim. Acta 91, 2003, 539-545.*

Mattigod, S. V., et al., Correlation of heavy metal binding capacity of thiol-SAMMS using the Misono softness parameter, Inorganic Chemistry Communications, 9, 2006, 96-98.*

Mattigod, S. V., et al., Anion binding in self-assembled monolayers in mesoporous supports (SAMMS), Inorganic Chemistry Communications, 10, 2007,646-648.*

Schwoachau, K., The Analytical Chemistry of Technetium, Topics in Current Chemistry, 96, 1981,109-147.*

International Search Report/Written Opinion for International Application No. PCT/US2011/049330, International Filing Date Aug. 26, 2011, Date of Mailing Jan. 9, 2012.

Mattigod, S. V., et al., Anion binding in self-assembled monolayers in mesoporous supports (SAMMS), Inorganic Chemistry Communications, 10, 2007, 646-648.

Schwoachau, K., The Analytical Chemistry of Technetium, Topics in Current Chemistry, 96, 1981, 109-147.

Fryxell, G. E., et al., Design and synthesis of self-assembled monolayers on mesoporous supports (SAMMS): The importance of ligand posture in functional nanomaterials, J. Mater. Chem., 17, 2007, 2863-2874.

Liu, J., et al., Synthesis and Applications of Functionalized Nanoporous Materials for Specific Adsorption, Studies in Surface Science and Catalysis, 129, 2000, pp. 729-738.

* cited by examiner

| | Sorbent | | | | Mo Loading (1hr) | | | | | |
|---|---|---|---|---|---|---|---|---|---|---|
| ID | SAMMS Material | Ligand | Anion | Mass, mg | Soln pH | Vol | Mo99 C(initial) μ=Ci/mL | Mo99 C(final μ=Ci/mL | Mo99 μ=Ci/g SAMMS | Mo μ=g/g SAMMS |
| 13–01 | SES#1 | Cu–EDA | $Cl_2$ | 40.1 | 4.91 | 5.9 | 1.24E–01 | 3.67E–03 | 17.65 | 95.61 |
| 13.02 | Davisil635 | Cu–EDA | $SO_4$ | 40.3 | 4.9 | 5.9 | 1.24E–01 | 9.87E–03 | 16.65 | 90.22 |
| 13.03 | SES#1 | Cu–EDA | $SO_4$ | 40.6 | 4.95 | 5.9 | 1.24E–01 | 2.23E–02 | 14.73 | 79.79 |
| 13–04 | PhenC | Carbon | $SO_4$ | 39.9 | 5.01 | 5.9 | 1.24E–01 | 7.67E–02 | 6.93 | 37.57 |
| 13–05 | Davisil635 | Cu–EDA | $SO_4$ | 40.6 | 4.94 | 5.9 | 124E–01 | 2.06E–02 | 14.97 | 81.13 |
| 13–06 | PhenC | Carbon | $SO_4$ | 40.8 | 5.02 | 5.9 | 1.24E–01 | 7.62E–02 | 6.85 | 37.11 |
| 13–07 | Control | NA | NA | 0 | 5.02 | 5.9 | 1.23E–01 | 1.24E–01 | NA | NA |

*Fig. 4*

| | Sorbent | | | | Generation (3 days) | | | | |
|---|---|---|---|---|---|---|---|---|---|
| ID | SAMMS Material | Ligand | Anion | Mass, mg | PH (i) | Mo99 μ=Ci/mL | Tc99m μ–Ci/mL | Vol (mL) | Φ, Ratio of Tc99m/M99 Activity |
| 13–01 | SES#1 | Cu–EDA | $Cl_2$ | 40.1 | 4.91 | 1.13E–04 | 7.51E–03 | 6.3 | 66 |
| 13.02 | Davisil 635 | Cu–EDA | $SO_4$ | 40.3 | 4.9 | 1.28E–04 | 1.00E–02 | 6.3 | 79 |
| 13.03 | SES#1 | Cu–EDA | $SO_4$ | 40.6 | 4.95 | 7.13E–05 | 5.15E–03 | 6.3 | 72 |
| 13–04 | PhenC | Carbon | $SO_4$ | 39.9 | 5.01 | 3.15E–04 | –3.75E–03 | 6.3 | 0 |
| 13–05 | Davisil 635 | Cu–EDA | $SO_4$ | 40.6 | 4.94 | 5.98E–05 | 7.90E–03 | 6.3 | 132 |
| 13–06 | PhenC | Carbon | $SO_4$ | 40.8 | 5.02 | 5.01–E04 | –8.27E–05 | 6.3 | 0 |

*Fig. 5*

METHOD AND SYSTEM FOR RADIOISOTOPE GENERATION

STATEMENT AS TO RIGHTS TO INVENTIONS MADE UNDER FEDERALLY-SPONSORED RESEARCH AND DEVELOPMENT

This invention was made with Government support under Contract DE-AC0576RLO1830 awarded by the U.S. Department of Energy. The Government has certain rights in the invention.

BACKGROUND OF THE INVENTION

1. Field of the Invention

The invention generally relates to methods and systems for the generation of radioisotope products and in one embodiment to the generation of technetium-99m.

2. Background Information

Technetium-99m (Tc-99m), the radioisotope most widely used in nuclear medicine diagnostic procedures, is used in the detection of cancer, heart disease and thyroid disease, along with the study of brain and kidney function and the imaging of stress fractures. Over the past two decades, the nuclear medicine industry has experienced intermittent shortages of molybdenum-99 (Mo-99), the parent of Tc-99m as a result of unplanned reactor outages. The world's supply of medical Mo-99 is primarily produced by five aging reactors in Canada, Europe, and South Africa, and at present no strategy exists to provide a global, long-term reliable supply of Mo-99. In addition, in the interest of nuclear security and non-proliferation, the U.S. and other countries are increasing the pressure to migrate the industry from using customary Highly Enriched Uranium (HEU) to Low Enriched Uranium (LEU) for the production of Mo-99.

There are a variety of available Mo99 production methods including U235(n,f)Mo99, U238(γ,f)Mo99, Mo98(n,γ)Mo99, and Mo100(γ,n)Mo99. A National Academy of Sciences study commissioned in 2009 recommended the irradiation of LEU in a fission reactor to produce Mo-99 where separation of Mo from the plurality of uranium fission products and actinides continues to be required to obtain high specific activity Mo-99. This makes the "fission product" Mo method economically challenging in view of the dedicated specialized radiochemical facilities and equipment and the increasing regulatory demands associated with uranium target manufacturing and the handling, storing, and disposing of the nuclear waste from fissioned uranium. There is a need for a more economical method to produce Tc-99m from Mo-99.

Producing Mo99 from natural or isotope-enriched Mo targets has the main advantage of eliminating the need for dedicated radiochemical facilities (hot cells) while producing nearly no waste stream compared with the fission product approach. For example, Mo99 produced from neutron capture of natural Mo (containing about 24% Mo98) provides certain advantages and is discussed herein in relationship to the invention (it is understood that the invention is not limited to such production mode of Mo99). There are two disadvantages to using Mo99 derived from neutron capture of natural molybdenum for Tc-99m generation. First, the low specific activity of such "neutron-capture" Mo-99 (i.e., number of curies of Mo99 per gram of Mo) typically requires very large Tc-99m generators and elution volumes when compared to conventional alumina generators using fission product Mo-99. Second, the separation of Tc-99m from the parent Mo-99 in a compact generator requires high selectivity (USP guidelines indicate that there must be less than 0.15 microcuries of Mo99 per millicurie of Tc-99m and no more than 10 micrograms of aluminum ion per milliliter of generator eluate). No effective ion exchange technology currently exists that provides sufficiently effective selective capture so as to enable high capacity sorption of Mo-99-containing molybdenum, while simultaneously providing the selective separation of the Tc-99m decay product from the molybdenum in those cases where the Mo-99 has low specific activity. What is needed therefore is a device and methodology for selective generation of daughter radioisotope products from parent materials that has sufficient specificity so as to allow for lower specific activity parent materials to be utilized. The present invention is a significant advancement in this regard.

SUMMARY

The present invention is a system and a process for producing selected isotopic daughter products from parent materials characterized by the steps of loading the parent material upon a sorbent having a functional group configured to selectively bind the parent material under designated conditions, generating the selected isotopic daughter products, and eluting said selected isotopic daughter products from the sorbent. In one embodiment, the process also includes the step of passing an eluent formed by the elution step through a second sorbent material that is configured to remove a preselected material from said eluent. In some applications a passage of the material through a third sorbent material after passage through the second sorbent material is also performed.

In one embodiment of the invention, the present invention is a process for generating Tc-99m and a system for carrying out such a process which includes dissolving Mo-99-containing molybdenum in a loading solution; and contacting the loading solution with preselected ion exchange material having a greater affinity for molybdate ion than technetium whereby the Mo-99 attaches to the ion exchange material, decays to Tc-99m and detaches from the ion exchange material to produce pertechnetate. The undecayed Mo-99 remains attached to the ion exchange material. The Mo-99-containing molybdenum can be produced through neutron capture of naturally occurring or enriched Mo98 to obtain a specific activity greater than 100 millicurie Mo99/gram of molybdenum. (MNCP calculations indicated a 1MW TRIGA reactor can achieve ~420 millicurie Mo99/gm after 144 hours of exposure. Seventy two hours provides almost 300 millicurie). The Tc-99m produced from the generator may be subsequently treated by various means to form labeled Tc99m complexes.

In one embodiment of the invention the preselected ion-exchange material is a silica based ion exchange material, built on a nanoporous silica support having a surface area greater than 400 $m^2/g$. Preferably, the pre-selected ion exchange material is a Self-Assembled Monolayers on Mesoporous Support (SAMMS) sorbent, having at least one functional group adapted to selectively bind with a preselected ion. While in this embodiment a silica based porous substrate is described it is to be distinctly understood that the invention is not limited thereto but may be variously alternatively embodied to include a variety of combinations of rigid porous substrates with a specific functional group configured to interface with a particular portion of a target material. Examples of materials that could be utilized as the porous substrate include carbon based materials, titania, zirconia, and germania, as well as ceramic oxides such as aluminas and aluminosilicates. These backbone structures are connected to a specific interface in a variety of ways. In one embodiment an organosilane interface is utilized to connect the functional group interface to the backbone structure. This configuration allows for a column that does not swell and provides increased surface area and loading thus allowing for lower specific activity parent feeds to be utilized.

In one application, the SAMMS sorbent is functionalized with a Copper-Ethylenediamine (CuEDA) complex, forming a binding site selectively configured to bind molybdate, allowing the sorbent to be so loaded. In another embodiment of the invention the sorbent includes a selective binding site formed by a metal thiolate-SAMMs material (e.g. silver thiolate SAMMS). While these two types of materials are described as particular embodiments of this invention, it is to be distinctly understood that a variety of materials and combinations could be utilized depending upon the particular needs and circumstances of the user.

For example, a similar methodology can be utilized to produce rhenium-188 (Re-188) from its parent tungsten188 (W-188). In such a process, tungsten oxide ($^{186}WO_3$) is irradiated in a reactor to produce W-188. Using known techniques such as mixing with 0.1 M NaOH containing 5% sodium hypochlorite solution, the W-188 can be dissolved. Once dissolved, this sodium tungstate solution can then acidified to pH 2-5 and loaded on a CuEDA SAMMS column. The half life of W-188 is 69 days and produces the decay product Re-188 with a half life of 17 hours. The $^{188}ReO_4^-$ oxoanion produced on the CuEDA SAMMS generator is preferentially released from the sorbent much as $TcO_4^-$ oxoanion does. The breakthrough of tungstate and other undesired constituents in the eluent is reduced by the use of metal capped thiol-SAMMS, such as thiol-SAMMS capped with silver. The silver capped thiol-SAMMS will sequester tungstate as $Ag_2WO_4$. The Re-188 can then be eluted with saline or with the salt of a weak acid such as ammonium acetate. In addition to this example a variety of other types of materials could be produced according to such a configuration in accordance with the needs and necessities of the user, examples of such materials include the obtaining of Y-90 from Sr-90, Ra-224 from Th-228, Pb-212 from Ra-224, Bi-212 from Pb-212, Ra-225 from Th-229, Ac-225 from Ra-225, Bi-213 from Ac-225, Th-227 from Ac-227, and Ra-223 from Th-227. In these later embodiments the sorbent material has a functional group comprising a material such as actinide phosphate SAMMs material, a hydrogen phosphate SAMMS material, or a glycinyl urea SAMMs material.

In some embodiments of the invention, additional sorbent contacting steps are included in the process either in the same structure as the first sorbent or in follow-on steps of a process. Such sorbents, for example, can help ensure sufficient radiochemical purity or concentration of the final radioisotope product for clinical use. In the embodiment of the invention for the generation of Tc-99m from Mo-99 a secondary sorbent phase (e.g. EDA SAMMS, thiol-SAMMs material, described in further detail hereafter) may be included to assist with the removal of copper from the eluent. In addition to utilization in the described embodiment, inclusion of a secondary capture material such as a thiol-SAMMS material as a follow on step or as an additional sorbent layer in a preexisting alumina type generator will provide increased purity. In addition to this secondary sorbent material a third type of material such as metal capped thiol SAMMS, such as silver (Ag) capped thiol SAMMs material may also be utilized to provide additional material specific capture. While this arrangement is shown and described it is to be distinctly understood that the invention is not limited to any specific embodiment or configuration and encompasses various alterations as dictated by the needs and necessities of the user.

In one embodiment of the invention the process further includes the step of concentrating the target material, in this case Tc-99m, to a target value, in this case at least 25 millicurie Tc-99m/Mr. In one embodiment of the invention this is done by incorporating a secondary column that will load pertechnetate and provide subsequent small volume elution of Tc-99m. This additional column may also include acid-alumina and amine-based sorbents. In some embodiments the pertechnetate is rinsed from the ion exchange material using a rinsing solution, such as deionized water or saline. In some embodiments the pH of the various loading, generating and eluting phases (wherein the Mo-99 is loaded on to the sorbent, allowed to decay on the sorbent to form Tc-99m, and then eluted to remove the Tc-99m from the column) are performed in a step wise manner with varying pH from a lower pH, preferably a pH of about 3 at the loading stage to a higher pH, pH of about 4 at the generating stage and then an even higher pH, pH of about 5 at the elution stage.

The present invention also includes a system for practicing the method described above. In one embodiment of the invention a Tc-99m generator is prepared by forming a packed particle sorbent column comprising Cu-EDA-SAMMS. Preferably this occurs in the particle range from about 50-300 microns and most preferably, at about 100 microns. While this configuration is shown it is to be distinctly understood that the sorbent is not limited solely to this structure and that a variety of other structures may also be utilized. Examples of these structures include but are not limited to packed beds, structured monoliths, coated structures, thin films, lined capillaries and other engineered forms. In other embodiments, another sorbent in addition to or in replacement of Cu-EDA-SAMMS may also be utilized. Examples of such other materials include a thiol-SAMMs, a capped metal thiol SAMMs material, or another sorbent having the desired properties. In applications where multiple sorbents are utilized to achieve a specific result these multiple sorbent sections need not necessarily be stacked, or even embodied in the same column as is shown in the detailed description provided hereinafter.

In use, a solution of dissolved Mo-99-containing Mo is contacted with the Cu-EDA SAMMS material preferably at a pH of about 3. This Mo-99-containing Mo then absorbs or loads on to the SAMMs material where it is held for a designated period of time. This lower pH helps to enhance the amount of loading upon the material. In one set of experiments a pH of 3 was estimated to provide Tc99m recovery to more than 90 percent. In one embodiment the column contains less than 500 mL of unsupported Cu-EDA-SAMMS and is capable of sorbing at least 1600 to 4800 millicurie of Mo-99, depending on if natural molybdenum or Mo-98-enriched molybdenum is used as the neutron-capture target material for irradiation. Once the material has been loaded, the pH is then raised to about 4. While this step is shown in one embodiment of the invention it is to be distinctly understood that the invention is not limited thereto but maybe variously embodied according to the needs and necessities of the user. As the Mo-99 decays to form Tc-99m, the remaining Mo-99 will be preferentially bound to the sorbent. After a designated period of time, typically at or around 24 hours (at which time the maximum Tc99m activity occurs), the Tc-99m is then eluted at a pH of about 5 wherein the reaction chemistries show a preference for releasing the Tc-99m. This eluant can be buffered de-ionized water, DI or sterile saline which will make the captured Tc-99m ready for use.

In some embodiments additional layers of absorbents within the same column, or different processing steps utilizing different absorbents passing the eluant though various other absorbent beds, other columns, or absorbent contact mechanisms may be desirable. The need or necessity to perform such actions may be precipitated by a variety of circumstances including but not limited to the specific activity of the Mo-99 containing material that is utilized, the substrate upon which the sorbent is placed, the interaction of these materials with the underlying acid, and other factors. As discussed previously in one embodiment of the invention, contacting the eluant from a standard alumina based Tc-99m generator to remove molybdate would result in a marked increase in the efficiency of these standard based systems and allow lower enriched or even naturally occurring Mo-99 to be utilized in these existing systems. The additional steps of contacting the eluant with various other sorbents could be done in a variety of ways. For example, in one example of one embodiment the absorbed Mo-99, when eluted with saline solution, provides a yield of 48% theoretical yield of Tc-99m over the life of the generator. When buffered to a neutral or near neutral pH labeling can then occur directly. In some embodiments the labeling is performed utilizing organic linkages so as to form labeled materials such as such as Tc99m[MIBI]$_6$ where MIBI is 2-methoxyisobutyl isonitrile. While this example is given it is to be distinctly understood that the invention is not limited thereto but may be variously alternatively embodied according to the needs of the user.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions are shown and described only the preferred embodiment of the invention, by way of illustration of the best mode contemplated for carrying out the invention. As will be realized, the invention is capable of modification in various respects without departing from the invention. Accordingly, the drawings and description of the preferred embodiment set forth hereafter are to be regarded as illustrative in nature, and not as restrictive.

BRIEF DESCRIPTION OF THE DRAWINGS

FIG. 4 shows the results after the loading step in one example of the present invention.

FIG. 5 shows the results of the Gamma Emission Spectroscopy for the Generation Tests with CuEDA SAMMS and carbon sorbent materials.

DETAILED DESCRIPTION OF THE INVENTION

The following description includes the preferred best mode of one embodiment of the present invention. It will be clear from this description of the invention that the invention is not limited to these illustrated embodiments but that the invention also includes a variety of modifications and embodiments thereto. Therefore, the present description should be seen as illustrative and not limiting. While the invention is susceptible of various modifications and alternative constructions, it should be understood that there is no intention to limit the invention to the specific form disclosed, but, on the contrary, the invention is to cover all modifications, alternative constructions, and equivalents falling within the spirit and scope of the invention as defined in the claims.

Figure 1A:
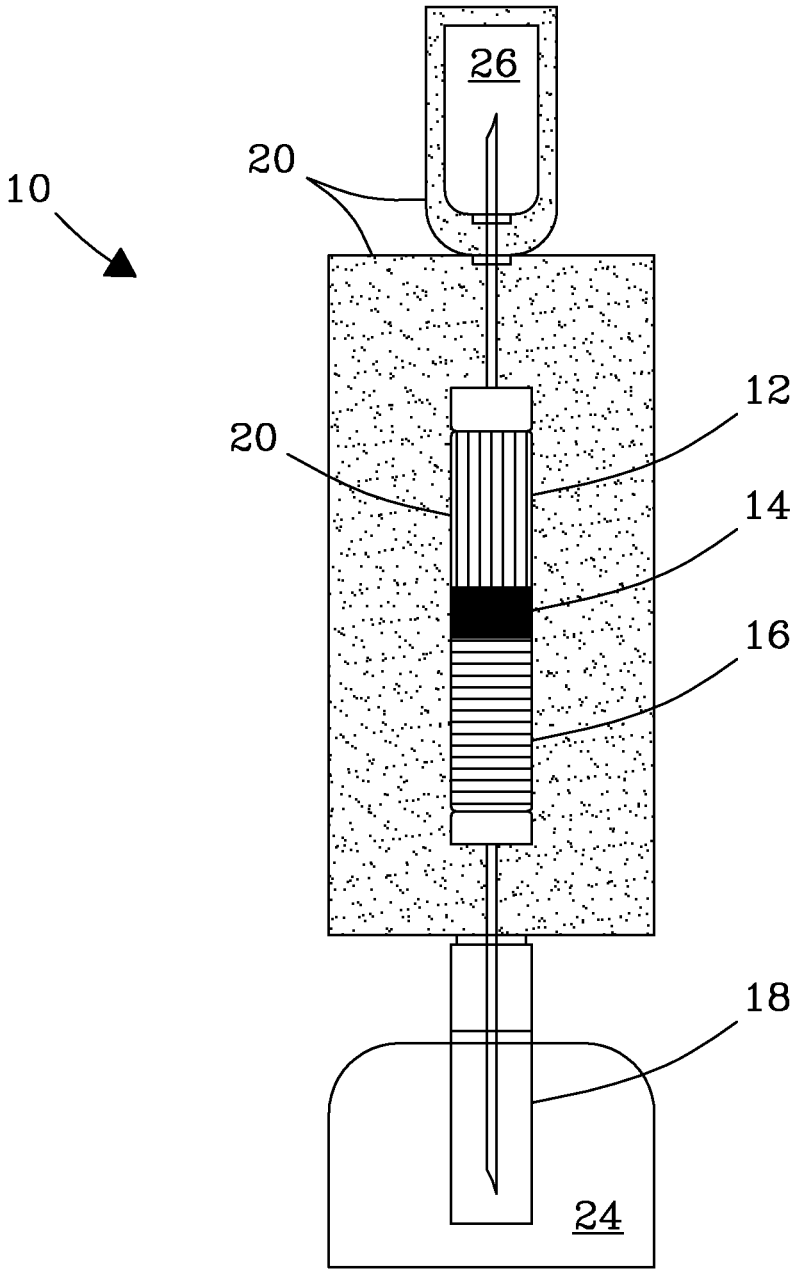
FIGS. 1(*a*) and 1(*b*) show examples of generator embodiments of the present invention.
Figure 1B:
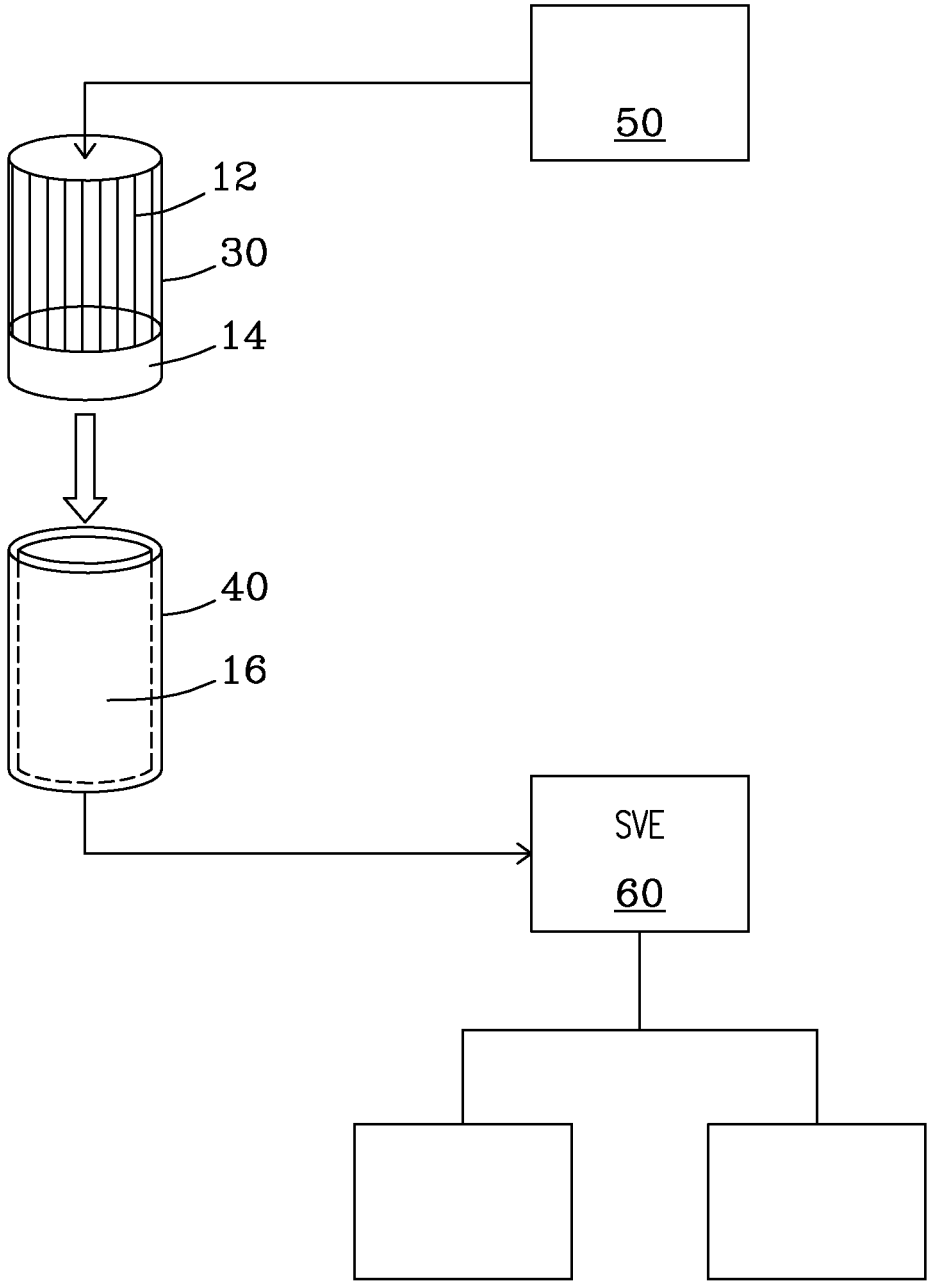

In one embodiment of the invention, shown in FIG. 1(*a*), a Tc-99m generator (10) is prepared with neutron-capture produced molybdenum [$^{98}$Mo(n,g)$^{99}$Mo] absorbed on Cu-EDA-SAMMS ion-exchange material (12). In this embodiment lead shielding (20) also protects the column (22) from the exterior. In this embodiment a secondary sorbent material, a thiol-SAMMS (14), as well as a third sorbent material, a metal-capped thiol-SAMMS material (16) are also included. The system also includes a means for obtaining sterile solutions of sodium pertechnetate Tc 99m from the decay of $^{99}$Mo through an eluent rinsing process, wherein an eluent such as sterile saline or deionized water is flushed from one reservoir 26 through the column 22 to a second reservoir 24. To reduce radiation exposure to personnel, the column (22) is shielded by lead (20). In some other embodiments, such as the embodiment shown in FIG. 1(*b*) the eluent is fed from a first column 30 to a secondary column 40 where further removal of unwanted products can take place. The eluent can then be fed to a small volume elution column (60) where concentration and/or further removal of unwanted products can then take place. Part of the eluent stream can be separated and utilized for labeling or other use while other portions can be recycled, for example through a reservoir 50, and fed back through the columns 30, 40. In some applications, subsequent third or fourth columns may also be incorporated for concentration and/or further removal of unwanted products. While in this embodiment it is shown that various combinations of the sorbents 12, 14, 16 are located in various positions in the flow it is to be distinctly understood that the invention is not limited thereto but may be variously alternatively embodied whereby the position and location of these sorbents may be variously alternatively positioned and embodied.

In one embodiment the column 22 contains less than 500 mL of unsupported Cu-EDA-SAMMS and is capable of sorbing at least 1600 to 4800 millicurie of $^{99}$Mo, depending on if natural molybdenum or $^{99}$Mo-enriched molybdenum is used as the neutron-capture target material for irradiation. The absorbed $^{99}$Mo, when eluted with saline solution, provides a yield of 48% theoretical yield of $^{99m}$Tc over the life of the generator. While this embodiment is shown, it is to be distinctly understood that such an invention is capable of a variety of various alterations and alternative configurations. While in one embodiment of the invention irradiated molybdenum is shown, natural molybdenum has also been shown to possess sufficiently high Mo-99 activity to function as a part of the present invention. Preferably, the activity of the Mo-99 has an activity of at least 100 millicurie Mo99/gram of molybdenum. However the present invention also enables for Tc-99m to be produced using Mo-99 at specific activities up to that approaching $1/100^{th}$ the activity of fission product Mo-99, or 5,000 curie/gram of molybdenum. While these examples are shown and described it is to be distinctly understood that the invention is not limited thereto but may be variously alternatively embodied according to the particular needs and necessities of a user.

The high surface area ion-exchange material utilized in one embodiment of the present invention is a self assembled monolayer of the type described in U.S. Pat. No. 6,531,224, and U.S. Pat. No. 6,326,326 the contents of each are herein incorporated by reference. This type of material referred to as a SAMMs material provides a variety of functionalized portions self assembled upon a substrate. In one embodiment a Cu-EDA-SAMMs material is utilized. The Cu-EDA reference refers to the types of ligands and functional groups that are present upon the surface of the SAMMs material. Examples of the ligands for Cu-EDA SAMMS, thiol-SAMMs and metal capped thiol-SAMMS, are shown in FIG. 2*a*-2*d*.

Figure 2A:
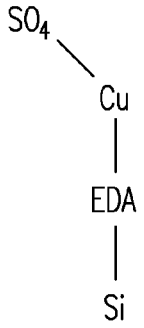
FIGS. 2*a*-2*f* show various examples of the functionalized capture portions of the materials utilized in the present invention.
Figure 2B:
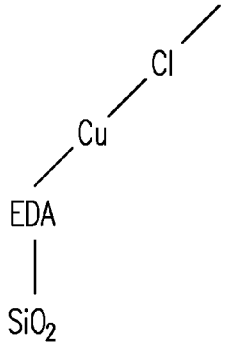
Figure 2C:
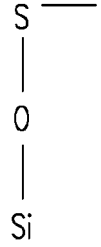
Figure 2D:
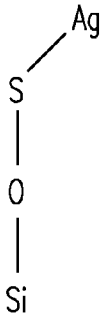
Figure 2E:
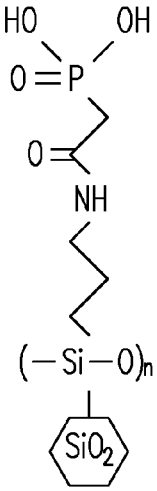
Figure 2F:
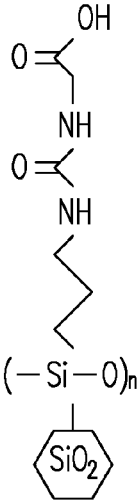
Figure 3:
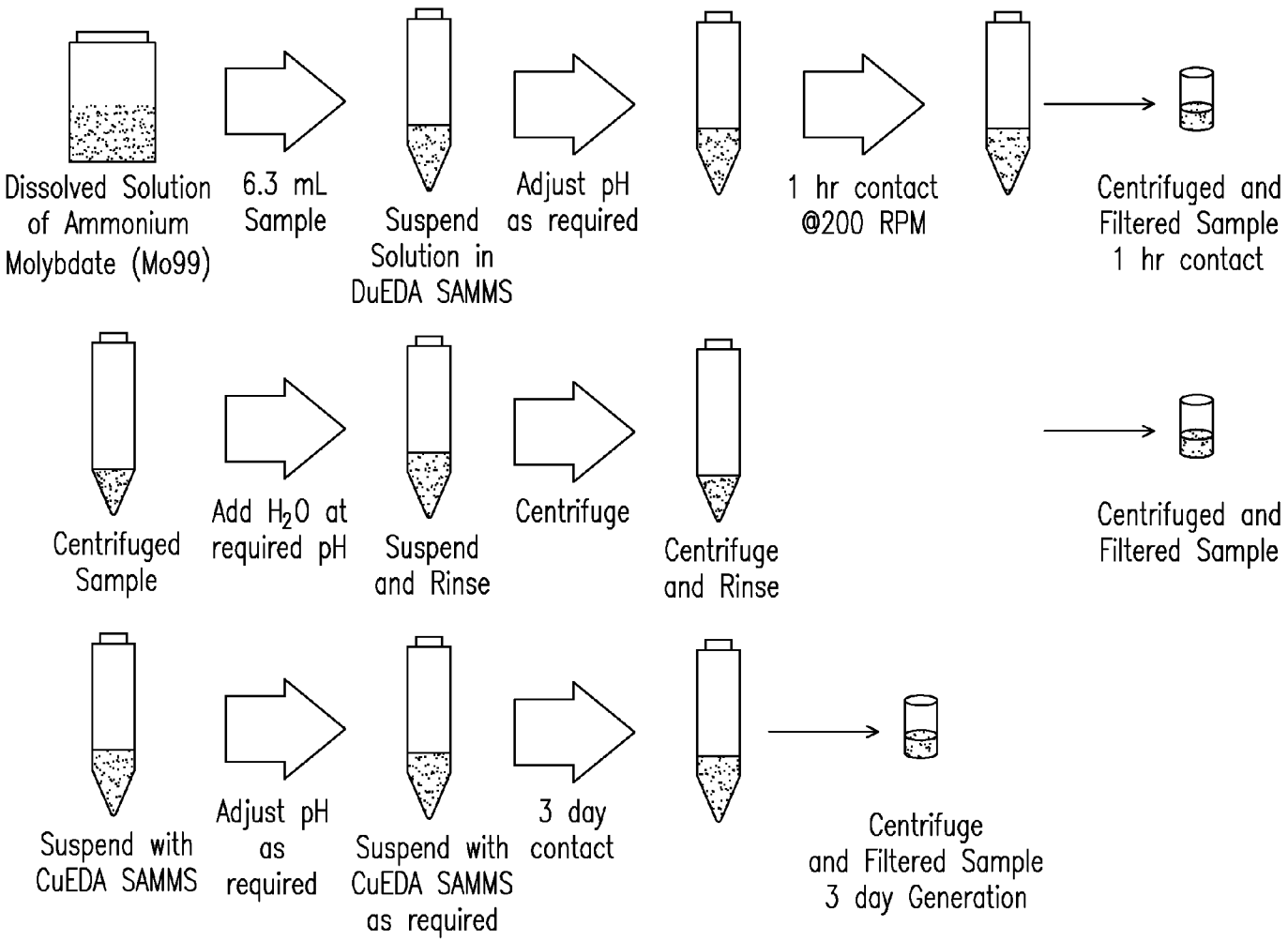
FIG. 3 shows a view of the testing protocol utilized in one embodiment of the present invention.

FIGS. 2*a* and 2*b* show two exemplary ligand structures for Cu-EDA-SAMMS. These materials have been shown to possess high loading capacity for molybdenum (sequestered as the anion molybdate) and are therefore good materials for capturing the activated molybdenum with Mo-99 activity. The high surface area of the silica mesoporous support (~400 $m^2/g$) enhances the loading capacity of the molybdenum anion (molybdate). Further, Cu-EDA-SAMMS possesses a higher affinity for molybdate than pertechnetate. The higher selectivity for molybdate over pertechnetate makes the Cu-EDA-SAMMS material a good candidate as a sorbent for the Tc-99m generator. FIG. 2(*c*) shows the general ligand structure for a thiol-SAMMS material while FIG. 2(*d*) shows the ligand structure of a metal in this case silver capped Thiol-SAMMs structure. In addition, amine based ligands, when attached to the mesoporous silica support structure display affinity for molybdate on the range of 76 mg/g of sorbent. FIGS. 2(*e*) and 2(*f*) show the structures of Acetamide Phosphate (AcPhos) SAMMs and Glycinyl-urea (Gly-Ur) SAMMs which are useful in other processes such as Th/Ra separations utilizing a structure and methodology similar to those taught in this application.

As is shown in FIGS. 3-6, in one set of testing regarding the present invention, approximately 40 milligrams of either CuEDA SAMMS or carbon sorbent was placed in conical tubes. Ammonium molybdate stock solution was then added. The pH of the slurries of sorbent and ammonium molybdate were adjusted to 5 using 0.1 M HCl. The quantity of sorbent in the batch contact tests was 0.040 gram of CuEDA SAMMS (or carbon sorbent), and 5.9 mL of solution, for a phase ratio of 147.5. After confirming the correct pH (5) for the slurries, the conical tubes were quickly capped and transferred to a rotary shaker. The slurries were contacted in a batch contact test for 1 hour in a rotary shaker set at 200 RPM. Sorbent was not added to conical tube ID 13-07, as a control. Conical tubes 13-04 and 13-06 contained the carbon sorbent which was used a comparison. A diagram of the batch contact test sequence for the Mo-99 loading is shown on the top row of illustrations in FIG. 3.

After the one hour of contact, the samples were centrifuged and filtered to retrieve a 2.0 mL aliquot for gamma counting. The results of the batch contact tests are shown in the table in FIG. 4. A total of seven batch contacts were performed, including the controls and tests with the carbon sorbent. All tests were performed at room temperature. Molybdenum loading for test 13-01 reports 17.65 microCi Mo99/g of SAMMS, (equal to 95 mg Mo/g of SAMMS) and is 20% greater than the reported molybdenum loading in previous cold (non-radioactive) tests. In cold tests the molybdenum loading was reported between 72-77 mg/g. In both tests the loading chemistry was pH 5.

After loading, each of the six test samples were rinsed three times in DI water adjusted to acidic pH. In each of the rinsates, the DIW was adjusted to pH 4 with 0.1 M HCl. The samples were centrifuged and filtered between each of the three rinsing steps. Generator solutions comprised of DIW, pH adjusted to either 2.5 or 3 were admitted to each of the six rinsed sorbent samples. The volume of the DIW was 6.3 mL. Given the nominal mass of the sorbent as 40 mg, the phase ratio for the generation tests was approximately 157 ml/g. After adding the identified generator solution to the vials containing the sorbents, the pH of the slurry was confirmed to be at the specified value and the generation date and time was recorded. The samples were allowed to generate Tc-99m for a period of about 3 days. The samples were placed in rotary shaker set at 200 RPM for 1 hour. At the conclusion of the hour, the samples were centrifuged for 3 minutes and filtered. The centrifuge and filtration or separation time was recorded. A sample of filtered solution was measured with gamma spectrometry for the Mo-99 and Tc-99m content. The results of the gamma measurements are shown in FIGS. 4-7.

Figure 6:
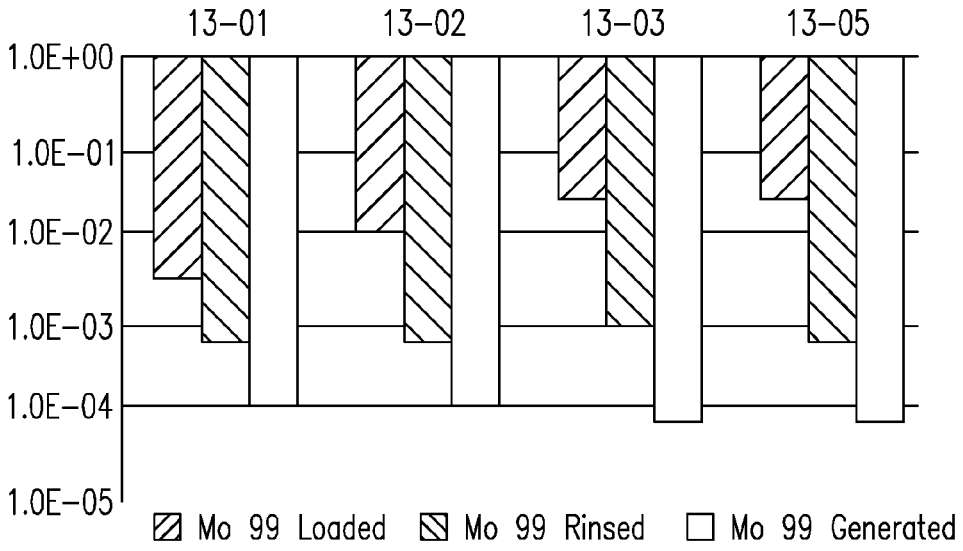
FIG. 6 shows the molybdenum (Mo-99) activity of the loading, rinsing and generator solutions when contacted with the candidate Cu-EDA sorbents.
Figure 7:
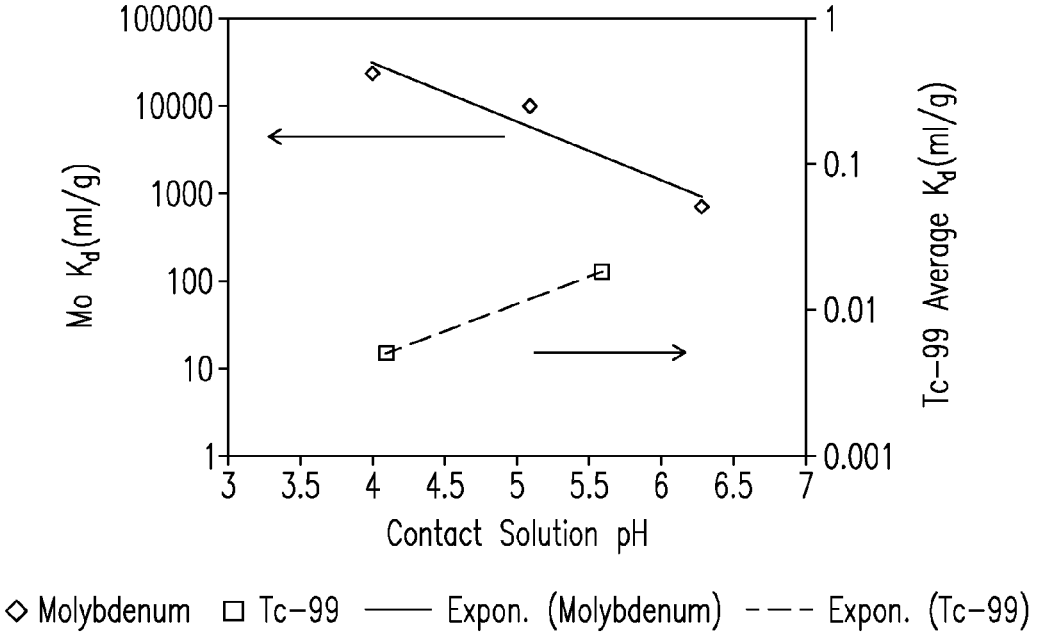
FIG. 7 shows the effect of pH on the loading of the parent isotope and the desorbing of the daughter products in one embodiment of the present invention.

FIG. 6 shows the Mo-99 activity of the loading, rinsing and generator solutions when contacted with the four candidate Cu-EDA sorbents. The plots of the four tests display a semi-log trend illustrating reduction of Mo-99 activity with each subsequent step. The reduction of Mo-99 activity in the contact solutions from the end of the rinsing step to the end of the generation step is attributed to both the increased sorption of molybdate from the solution and the decay of Mo-99. The half life of Mo-99 is 2.6 days, so the 3-day generation period alone will result in about one half reduction in the Mo-99 activity measurements. The Mo-99 activity in the generating solution is reduced by a factor of between 3 and 13. The Tc-99m trend for the CuEDA SAMMS materials displays a significantly different trend than those observed for the Mo-99 activity in the same test. Comparing the rinsate solutions to the generator solutions, the Tc-99m activity increased by a factor of 2-4 times.

The yield of Tc99m from the decay of the Mo99 can be estimated by knowing: (1) the activity of Mo99 loaded on the sorbent, (2) the activity of the Tc99m in the generator solution, and (3) the separation time of the generator solution. The decay of Mo99 occurs in two-path decay chain, via the beta decay to Tc99m followed by isomeric transition to Tc99. The half life of parent Mo99 (66 hr), is ten times the half life of daughter Tc99m, (6.0 hr). In secular equilibrium, the fraction of Mo99 decaying to Tc99m is 87.5%.

Various alterations to the basic example may be made so as to tailor the device and the process toward a specific end. For example, the studies revealed that the separation of Tc-99m from Mo-99 can be facilitated by sequentially lowering the pH of the load, rinse and generating solutions (from 5 to 4 to 3) respectively to achieve improved separation of Tc-99m from Mo-99. However, the data also indicates a lower (34%) utilization of the Tc-99m, suggesting the low pH of the generating solution enhanced the polymerization condensation of the sorbed molybdate and prevents Tc-99m from detachment. The results suggest using CuEDA SAMMS in acid conditions to generate Tc-99m may reduce its recovery due to polymerization condensation of the molybdate. Achieving improved removal of molybdenum from Cu-EDA SAMMs generator eluent may be made by selecting a sorbent or combination of materials exhibiting high selectivity of the removal of molybdate from pertechnetate solution. An example of such a material is silver thiolate-SAMMs, however a variety of other materials may also be utilized, these include but are not limited to; Cu-EDA SAMMS, Fe-EDA SAMMS, copper thiolate SAMMS, 8-hydroxyquiniline SAMMs or other materials that utilize a preselected ligand or functional group attached to a porous backbone structure.

In another embodiment of the invention concentrating the Tc-99m in the generator solution to at least 25 millicurie/mL by incorporating a secondary column that will load pertechnetate and provide subsequent small volume elution of Tc-99m may also be utilized. Preferably, the secondary column will have a sufficient loading capacity for pertechnetate. The recommended class of sorbents for the volume reduction is amine-based sorbents, such as aminopropyl SAMMS, EDA SAMMS, diethylenetriamine (DETA) SAMMS, or other materials that utilize a preselected ligand or functional group attached to a porous backbone structure. In addition to altering the various sorbents that are utilized, improved recovery of pertechnetate from the Cu-EDA-SAMMs sorbent can be obtained by selecting loading, rinsing and generating solutions to reduce polymerization condensation of molybdate. It is recommended that the pH of the loading, rinsing or generating solution be raised to reduce the polymerization of molybdate and its likely interference to the release (or detachment) of pertechnetate from CuEDA SAMMS. The present invention can also be used to produce labeling compounds such as those used in Sestamibi, DTPA and MAA scans. In some applications it will be possible to obtain a final Tc-99m separation well above the target baseline of 6,700 (Tc-99m/Mo-99), and sufficient elution performance to achieve at least 25 millicurie/mL when starting with a fully irradiated target.

While various preferred embodiments of the invention are shown and described, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A process for producing selected isotopic daughter products from parent materials characterized by the steps of:

binding said parent material upon a SAMMS sorbent material configured to selectively bind said parent material over said isotopic daughter product, generating said selected isotopic daughter products from the parent material while the parent material is bound to the SAMMS sorbent material; and eluting said selected isotopic daughter products from the SAMMS sorbent material.

2. The process of claim 1 further comprising the step of passing an eluent formed by said elution step through a second sorbent material to remove a preselected material from said eluent.

3. The process of claim 2 further comprising the step of passing said eluent through a third sorbent material after passage through said second sorbent material.

4. The process of claim 1 wherein said parent material comprises Mo-99, and said daughter product comprises Tc-99m.

5. The process of claim 4 wherein said sorbent comprises a Cu-EDA-SAMMS material.

6. The process of claim 4 wherein said sorbent comprises a thiol SAMMS material,

7. The process of claim 4 wherein said sorbent comprises a metal capped thiol-SAMMS material.

8. The process of claim 1 wherein said binding, generating and eluting steps each take place at a different pH.

9. The process of claim 8 wherein said binding step takes place at a lower pH than said generating step, and said eluting step takes place at a higher pH than said generating step.

10. The process of claim 8 wherein said eluting step has a higher pH than either said binding step or said generating step.

11. The process of claim 4 wherein the Mo-99 is produced by Mo98 (n,γ)Mo99.

12. The process of claim 4 wherein the Mo-99 is produced by Mo100(γ,n)Mo99.

13. The process of claim 11 wherein the irradiated Mo-99 has a specific activity greater than 100 millicuries Mo99/gram of molybdenum.

14. The process of claim 4, wherein said parent material comprises molybdenum and Mo-99 where the specific activity of the Mo-99 is less 5,000 curie Mo99/gram of molybdenum.

15. The process of claim 4 further comprising the step of concentrating the Tc-99m to at least 25 millicurie/mL by passing said eluent through a secondary column that will bind pertechnetate and provide subsequent small volume elution of Tc-99m.

* * * * *

UNITED STATES PATENT AND TRADEMARK OFFICE

CERTIFICATE OF CORRECTION

PATENT NO. : 8,781,055 B2
APPLICATION NO. : 12/939081
DATED : July 15, 2014
INVENTOR(S) : Toth et al.

It is certified that error appears in the above-identified patent and that said Letters Patent is hereby corrected as shown below:

In the specification

Column 3, lines 23-24 – Replace “then acidi-fied” with --the be acifified--

Column 4, line 54 – Replace “but maybe” with --but may be--

Column 7, line 57 – Replace “used a comparison” with --used as a comparison--

Signed and Sealed this
Ninth Day of February, 2016

Michelle K. Lee

Michelle K. Lee
*Director of the United States Patent and Trademark Office*